US010035677B2

(12) United States Patent
Chen et al.

(10) Patent No.: US 10,035,677 B2
(45) Date of Patent: Jul. 31, 2018

(54) MAGNETIC RETRACTABLE LINE DIVIDER

(71) Applicants: Shu-Ming Chen, Taichung (TW); Yi-Lung Lee, Taichung (TW); Tsair-Rong Chen, Changhua (TW); Yu-Lin Juan, Changhua (TW)

(72) Inventors: Shu-Ming Chen, Taichung (TW); Yi-Lung Lee, Taichung (TW); Tsair-Rong Chen, Changhua (TW); Yu-Lin Juan, Changhua (TW)

(73) Assignees: Tera Autotech Corporation, Taichung (TW); Dept. of Electrical Engineering, National Changhua University of Education, Changhua (TW)

( * ) Notice: Subject to any disclaimer, the term of this patent is extended or adjusted under 35 U.S.C. 154(b) by 0 days.

(21) Appl. No.: 15/387,352

(22) Filed: Dec. 21, 2016

(65) Prior Publication Data

US 2018/0170709 A1 Jun. 21, 2018

(51) Int. Cl.

| | |
|---|---|
| ***E01F 13/00*** | (2006.01) |
| ***B65H 75/44*** | (2006.01) |
| ***B65H 75/48*** | (2006.01) |
| ***E01F 13/02*** | (2006.01) |

(52) U.S. Cl.

CPC ..... *B65H 75/4463* (2013.01); *B65H 75/486* (2013.01); *E01F 13/022* (2013.01); *E01F 13/028* (2013.01); *B65H 2701/374* (2013.01)

(58) Field of Classification Search

CPC ..... B65H 2701/374; B65H 75/4463; B65H 75/486; E01F 13/022; E01F 13/028

See application file for complete search history.

(56) References Cited

U.S. PATENT DOCUMENTS

| | | | | |
|---|---|---|---|---|
| 4,858,551 | A * | 8/1989 | Peters | B60Q 7/005 116/30 |
| 6,375,164 | B1 * | 4/2002 | Siegler | E01F 13/028 256/1 |
| 7,909,310 | B2 * | 3/2011 | Weiner | E01F 13/028 256/45 |
| 8,118,250 | B1 * | 2/2012 | Helseth | B65H 75/425 242/379 |
| 9,175,450 | B2 * | 11/2015 | Weiner | E01F 13/028 |
| 2005/0023403 | A1 * | 2/2005 | Lu | B65H 75/4447 242/381.5 |

(Continued)

FOREIGN PATENT DOCUMENTS

| | | | | |
|---|---|---|---|---|
| FR | 2816338 | A1 * | 5/2002 | E01F 13/02 |

*Primary Examiner* — Jonathan P Masinick
*Assistant Examiner* — Matthew R McMahon
(74) *Attorney, Agent, or Firm* — Che-Yang Chen; Law Offices of Scott Warmuth

(57) ABSTRACT

A magnetic retractable line divider may include at least a reel assembly having a shell, and a magnetic portion is installed thereon. An elastic line divider belt is wound on the reel assembly, and a magnetic member is connected to a lateral end of the line divider belt. The line divider belt is configured to be horizontally pulled out from the reel assembly and travel a preferred distance to attach to a magnetic object, thus achieving line divider effect. Moreover, when someone pushes against the line divider belt with or over a preferred force, the magnetic member is configured to be detached from the magnetic object and automatically retracted into the reel assembly, thus avoiding accident.

6 Claims, 14 Drawing Sheets

(56) References Cited

U.S. PATENT DOCUMENTS

| | | | | |
|---|---|---|---|---|
| 2005/0191107 | A1* | 9/2005 | Christie | B65H 75/4442 400/208 |
| 2005/0220537 | A1* | 10/2005 | Bentley | B65H 75/38 404/9 |
| 2007/0295851 | A1* | 12/2007 | Metz | B65H 75/4442 242/381 |
| 2014/0014760 | A1* | 1/2014 | Tsai | B65H 75/4447 242/396 |
| 2015/0218848 | A1* | 8/2015 | Weiner | E01F 13/028 256/47 |
| 2016/0047953 | A1* | 2/2016 | Crawley | G02B 5/136 256/65.02 |
| 2016/0244923 | A1* | 8/2016 | Green | E01F 13/028 |
| 2017/0167093 | A1* | 6/2017 | Punzengruber | E01F 13/028 |

* cited by examiner

MAGNETIC RETRACTABLE LINE DIVIDER

FIELD OF THE INVENTION

The present invention relates to a retractable line divider, and more particularly to a magnetic retractable line divider that can be used in a safer manner.

BACKGROUND OF THE INVENTION

The retractable line divider is commonly used at an entrance of supermarket, mall, and other public places for access control.

So far, a conventional retractable line divider (50) comprises at least two free-standing vertical posts (51) which are separated with a preferred distance (as shown in FIG. 14), and each of the vertical posts (51) has a reel assembly (52) formed at an upper portion thereof. A plurality of engaging slots (521) are located around an outer periphery of the reel assembly (52), and an elastic line divider belt (53) is wound on the reel assembly (52). Moreover, an engaging piece (531) located at an end of the line divider belt (53) is configured to engage with a preferred engaging slot (521) on the other reel assembly (52), thus building the line divider and achieving access control.

However, the conventional retractable line divider is disadvantageous because the engagement between the engaging piece (531) and the engaging slot (521) cannot be disengaged quickly, and it may increase risks in emergency or disasters such as fire or earthquake. Therefore, there remains a need for a new and improved design for a retractable line divider to overcome the problems presented above.

SUMMARY OF THE INVENTION

The present invention provides a magnetic retractable line divider which comprises at least a reel assembly. The reel assembly has a shell, and a magnetic portion is installed thereon. An elastic line divider belt is wound on the reel assembly, and a magnetic member is connected to a lateral end of the line divider belt. The line divider belt is configured to be horizontally pulled out from the reel assembly and travel a preferred distance to attach to a magnetic object, thus achieving line divider effect. Moreover, when someone pushes against the line divider belt with or over a preferred force, the magnetic member is configured to be detached from the magnetic object and automatically retracted into the reel assembly, thus avoiding accident. Furthermore, an upper locating disk and a lower locating disk are respectively located inside the shell of the reel assembly, and a spindle configured to be wound by the line divider belt is pivotally connected between the upper locating disk and the lower locating disk. A clock spring is positioned in the lower locating disk, and two ends of the clock spring respectively bear against a bottom portion of the spindle and an inner lower surface of the lower locating disk. As a result, the clock spring compressed or extended between the spindle and the lower locating disk is configured to provide an elastic force to retract or extend the line divider belt. Also, the shell comprises at least a slot which is configured to be passed through by the line divider belt. As needed, the shell of the reel assembly has an engaging base mounted thereon.

Comparing with conventional retractable line divider, the present invention is advantageous because: (i) the line divider belt of one reel assembly is configured to attach to the magnetic portion of another reel assembly, the magnetic member of the line divider belt of another reel assembly, or the magnetic unit of the walls through magnetic force, instead of the engagement, so that the line divider belt is configured to detach from these said objects when received over a preferred force and automatically retracted into the reel assembly. Thus, it can be used more safely in daily life or in emergency.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
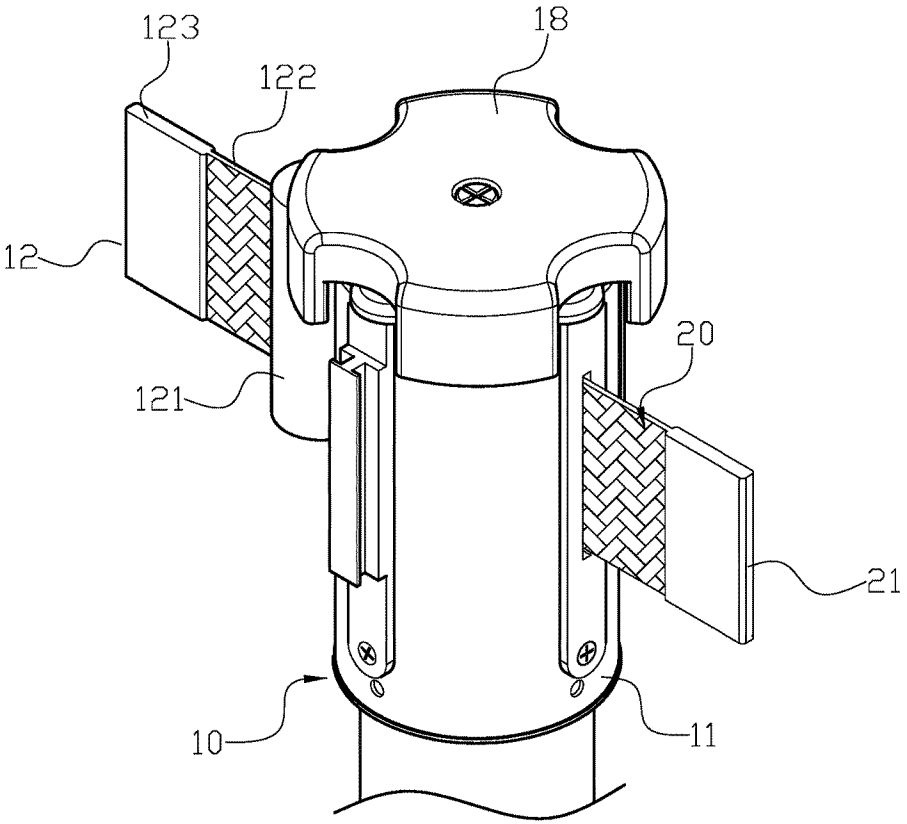
FIG. 1 is a three-dimensional assembly view of a magnetic retractable line divider of the present invention.
Figure 2:
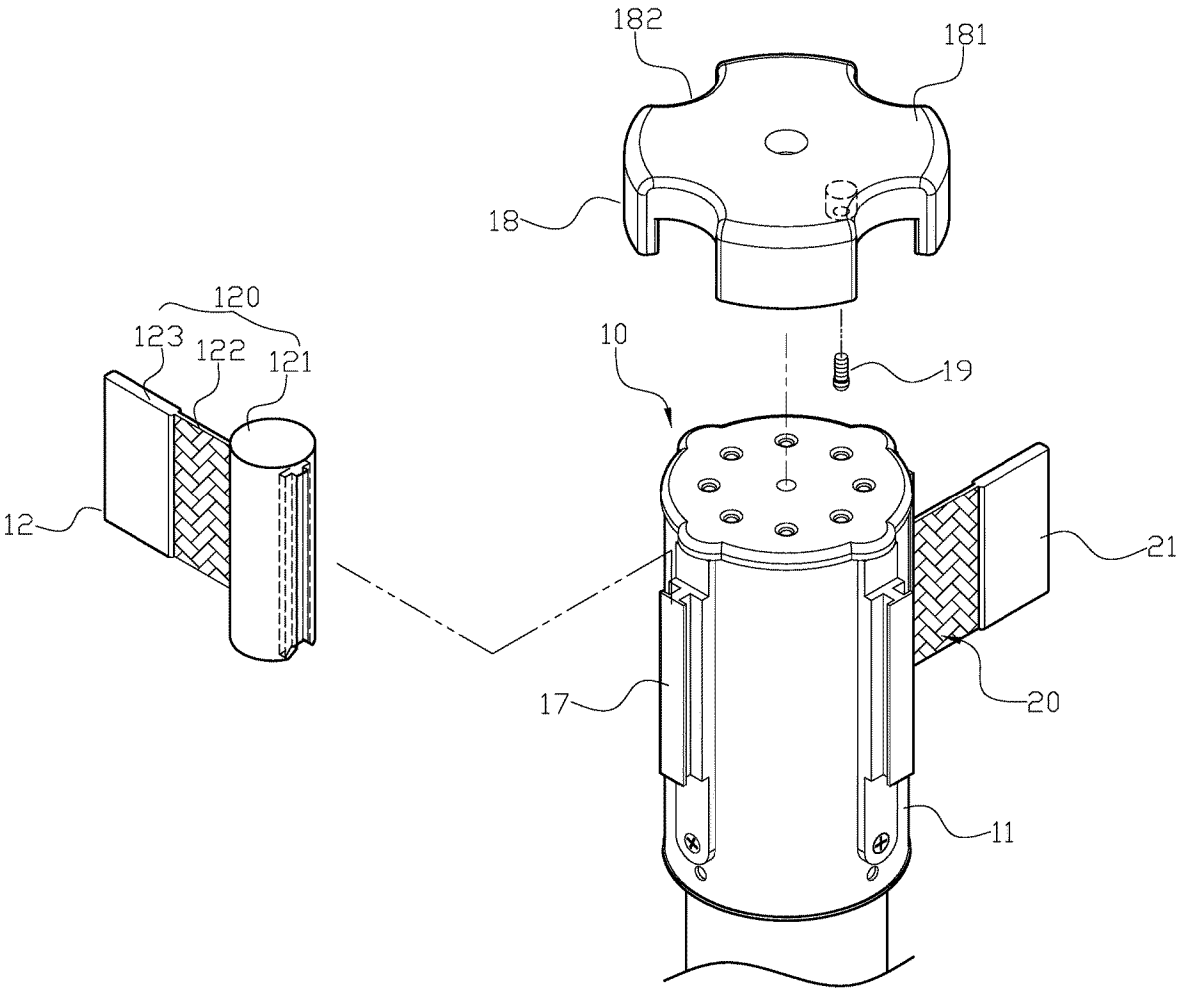
FIG. 2 is a three-dimensional exploded view of the magnetic retractable line divider of the present invention.
Figure 3:
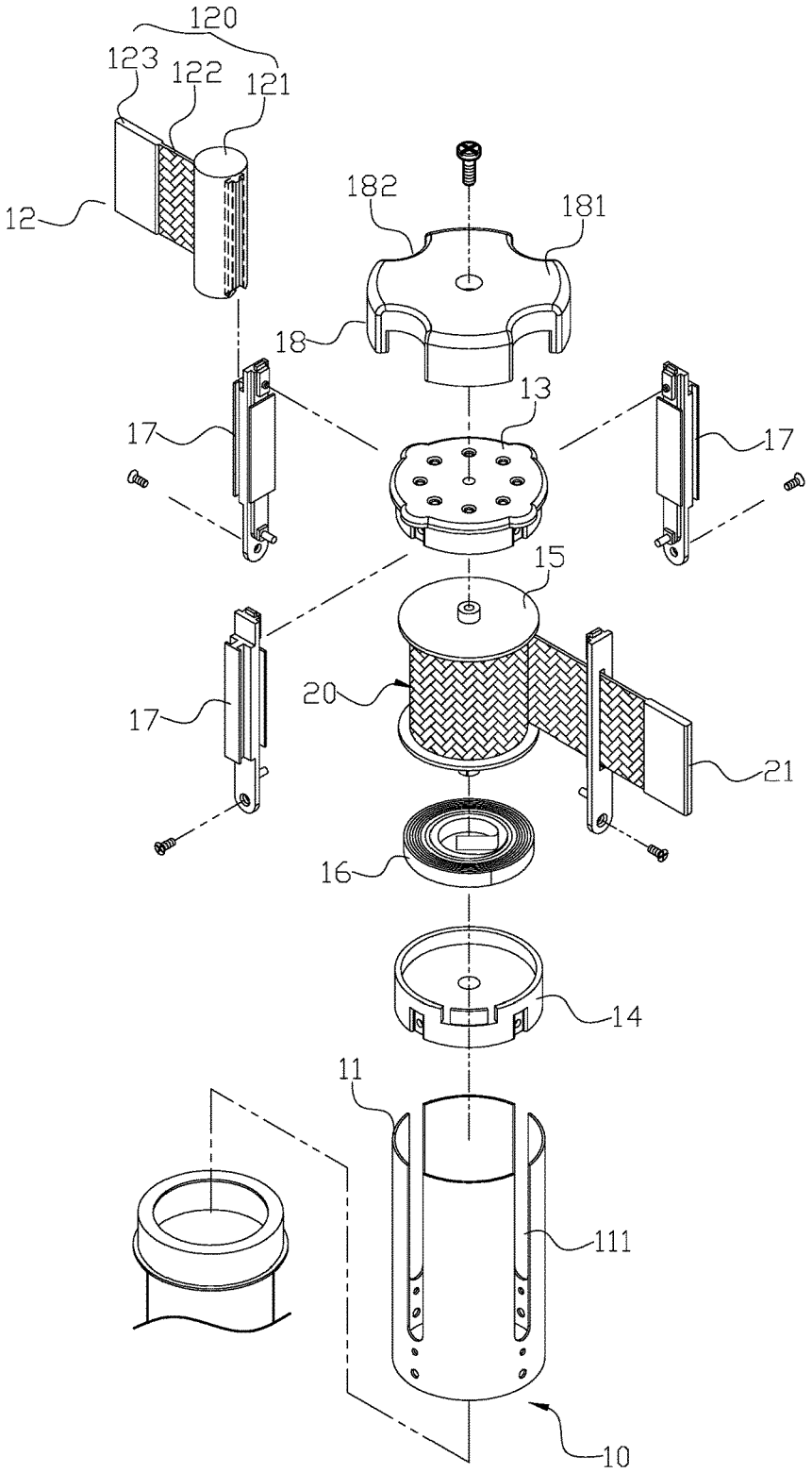
FIG. 3 is a detailed exploded view of the magnetic retractable line divider of the present invention.

In order to further understand the goal, characteristics and effect of the present invention, a number of embodiments along with the drawings are illustrated as following:

Referring to FIGS. 1 to 3, the present invention provides a magnetic retractable line divider which comprises at least a reel assembly (10). The reel assembly (10) has a shell (11), and a magnetic portion (12) is installed thereon. An elastic line divider belt (20) is wound on the reel assembly (10), and a magnetic member (21) is connected to a lateral end of the line divider belt (20). The line divider belt (20) is configured to be horizontally pulled out from the reel assembly (10) and travel a preferred distance to attach to a magnetic object, thus achieving line divider effect. Moreover, when someone pushes against the line divider belt (20) with or over a preferred force, the magnetic member (21) is configured to be detached from the magnetic object and automatically retracted into the reel assembly (10), thus avoiding accident. Furthermore, an upper locating disk (13) and a lower locating disk (14) are respectively located inside the shell (11) of the reel assembly (10), and a spindle (15) configured to be wound by the line divider belt (20) is pivotally connected between the upper locating disk (13) and the lower locating disk (14). A clock spring (16) is positioned in the lower locating disk (14), and two ends of the clock spring (16) respectively bear against a bottom portion of the spindle (15) and an inner lower surface of the lower locating disk (14). As a result, the clock spring (16) compressed or extended between the spindle (15) and the lower locating disk (14) is configured to provide an elastic force to retract or extend the line divider belt (20). Also, the shell (11) comprises at least a slot (111) which is configured to be passed through by the line divider belt (20). As needed, the shell (11) of the reel assembly (10) has an engaging base (17) mounted thereon.

Figure 4:
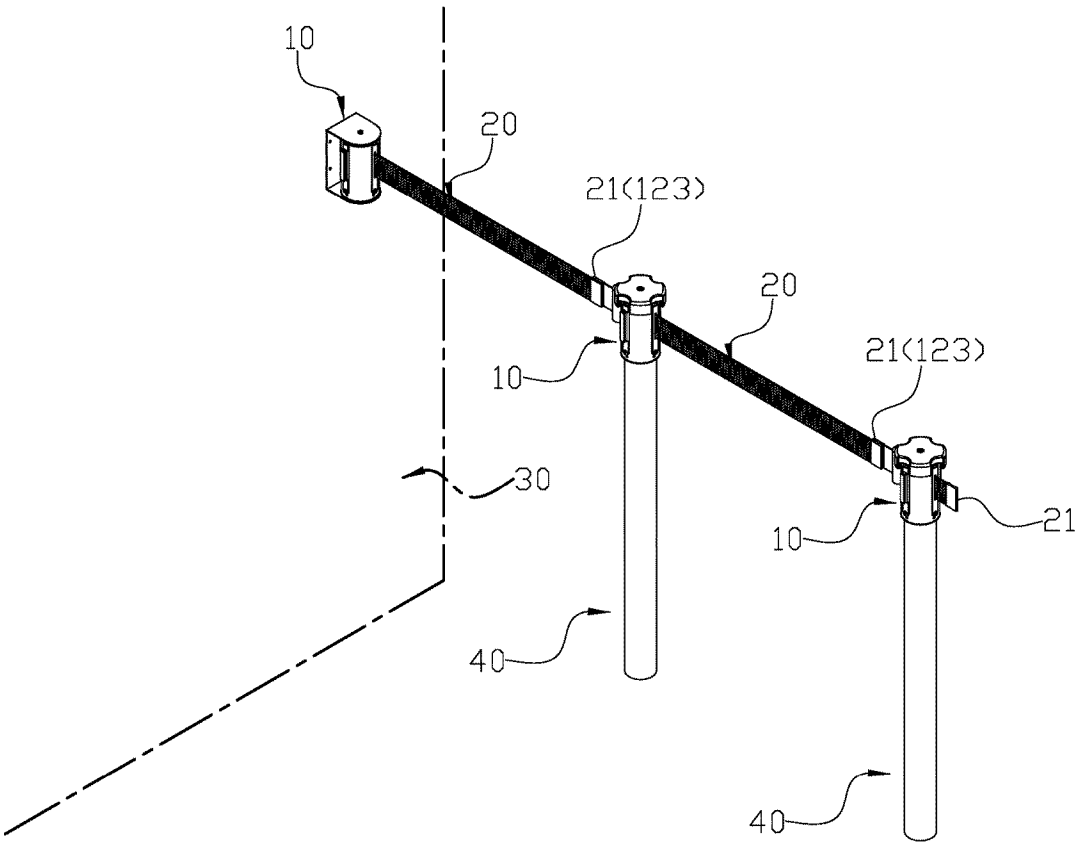
FIG. 4 is a schematic view of the magnetic retractable line divider of the present invention when in use.

In one embodiment, the magnetic portion (12) comprises at least a connecting unit (120), and the connecting unit (120) further has a locating piece (121) which is configured to engage with the engaging base (17). In addition, the connecting unit (120) has a magnetic piece (123), and a line divider section (122) is connected between the magnetic piece (123) and a lateral edge of the locating piece (121) (as shown in FIGS. 1 to 3). Thus, a user can pull the line divider belt (20) out from the reel assembly (10) and attach the magnetic member (21) to the magnetic piece (123) of the conning unit (120) on another reel assembly (10), thus building a line divider (as shown in FIG. 4). Moreover, in order to prevent the connecting unit (120) from been stolen or the magnetic piece (123) from accidentally attaching to adjacent magnetic objects, a rotatable cover (18) is installed on the reel assembly (10). Wherein the cover (18) has at least two convex portions (181) and at least two concave portions (182) arranged alternatively around an outer periphery thereof. The cover (18) is configured to be turned to allow the either of the convex portions (181) to align with the connecting unit (120), thereby preventing the connecting unit (120) from been removed from the engaging base (17). Conversely, the connecting unit (120) is configured to be allowed to disengage with the engaging base (17) when aligned with either of the concave portions (182) of the cover (18). Also, a locating unit (19) installed between the cover (18) and the upper locating disk (13) is configured to position the cover (18) after each turn.

Figure 5:
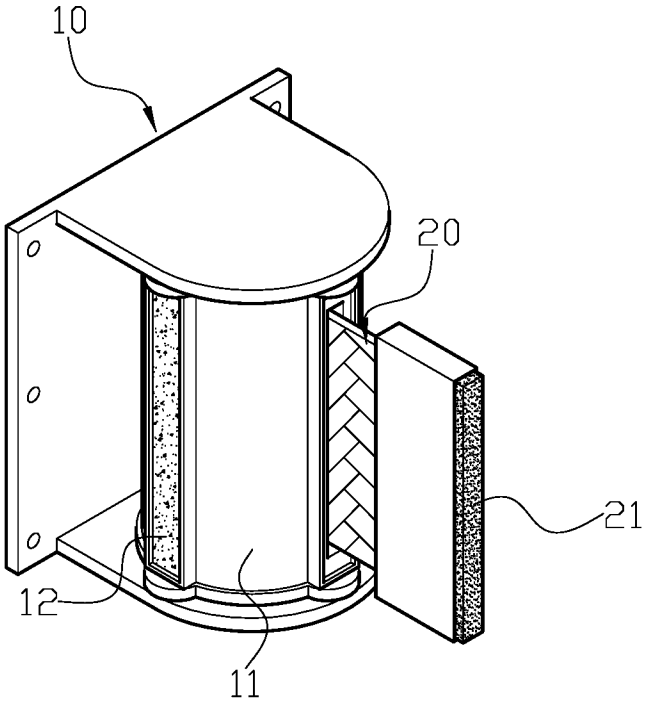
FIG. 5 is a three-dimensional assembly view of the second embodiment of the magnetic retractable line divider of the present invention.

In another embodiment, the magnetic portion (12) is a plurality of metal pieces evenly formed on the shell (11) of the reel assembly (10) (as shown in FIG. 5).

In still another embodiment, the magnetic portion (12) is a plurality of magnets evenly formed on the shell (11) of the reel assembly (10) (as shown in FIG. 5).

Figure 6:
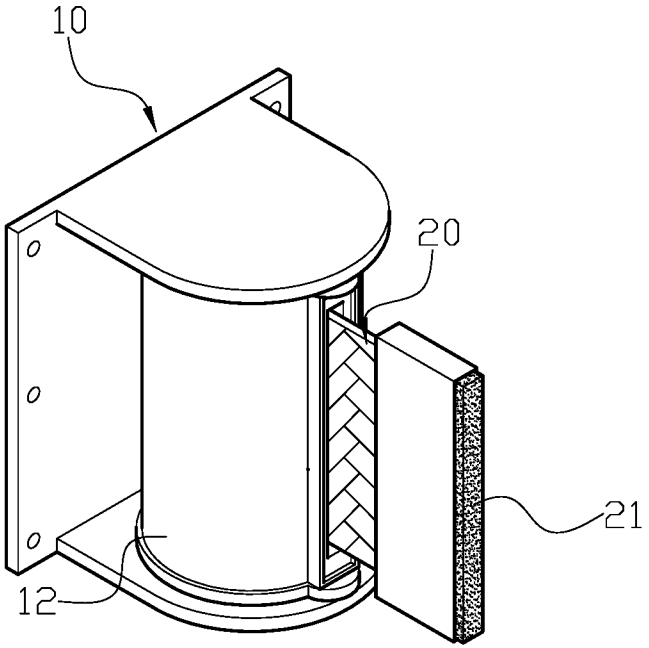
FIG. 6 is a three-dimensional assembly view of the third embodiment of the magnetic retractable line divider of the present invention.

In a further embodiment, the magnetic portion (12) is a piece of metal sheet attached on the shell (11) of the reel assembly (10) (as shown in FIG. 6).

In still a further embodiment, the magnetic member (21) is a magnet.

Figure 7:
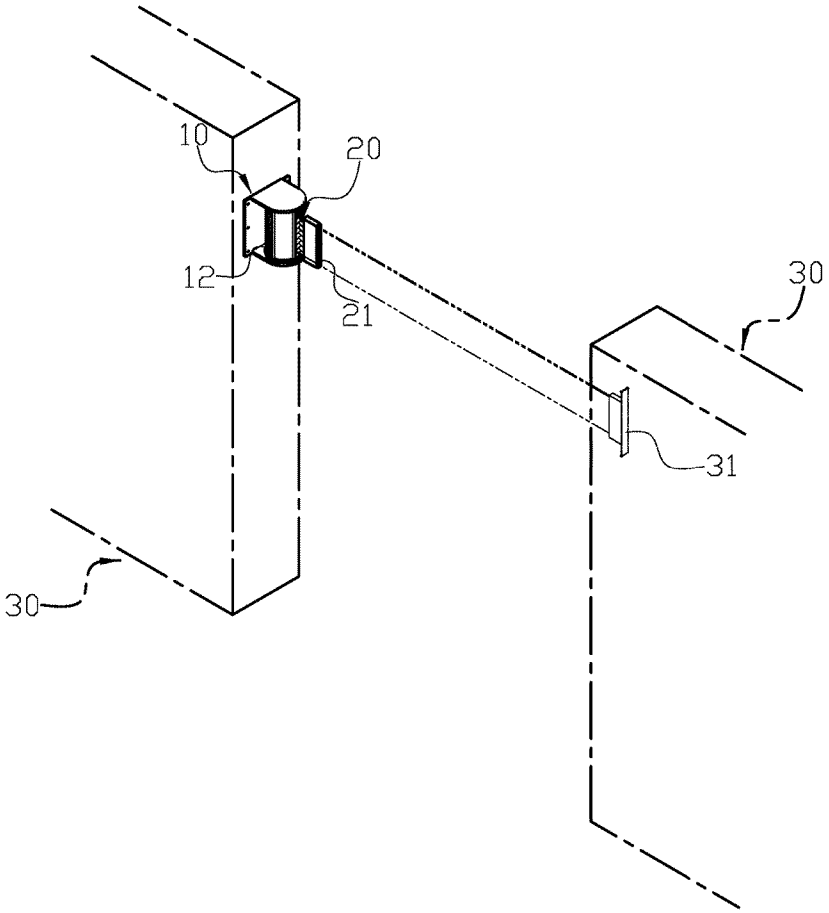
FIG. 7 is a schematic view of the second embodiment of the magnetic retractable line divider of the present invention when in use.

In yet a further embodiment, the reel assembly (10) is secured on a wall (30) located adjacent to an entrance or access, and a magnetic unit (31) is embedded in another wall (30) located at an opposite side of the first wall (30) (as shown in FIG. 7). Thus, after pulled out from the reel assembly (10), the line divider belt (20) is configured to attach on the wall (30) having the magnetic unit (31) through magnetic force, thus building a line divider for the entrance or assess. Wherein the magnetic unit (31) is a metal piece or a magnet.

Figure 8:
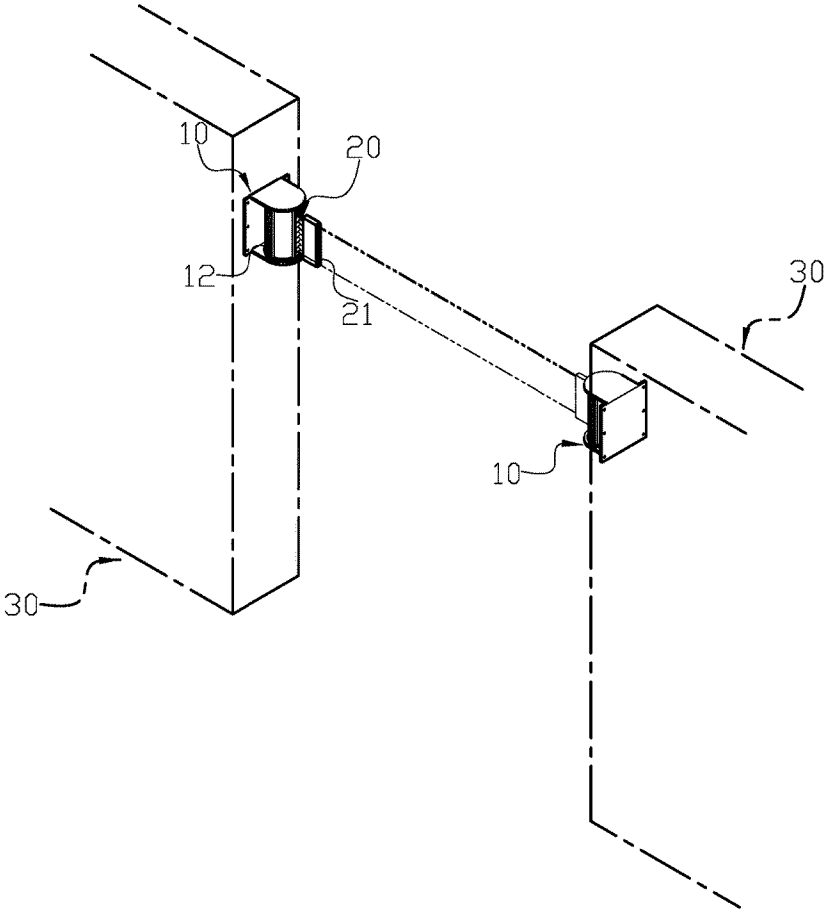
FIG. 8 is another schematic view of the second embodiment of the magnetic retractable line divider of the present invention when in use.
Figure 9:
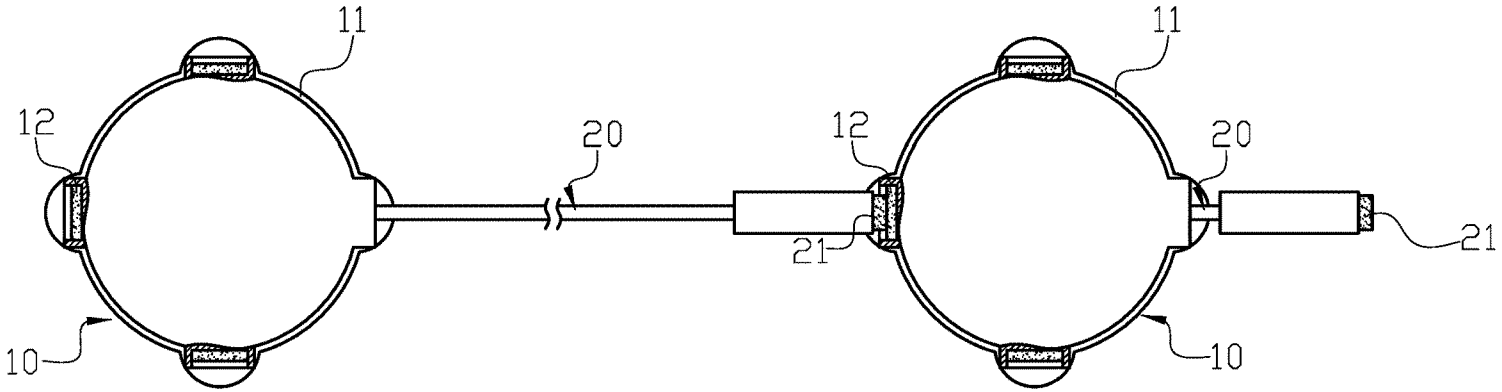
FIG. 9 is a detailed view illustrating an attaching mechanism of the magnetic retractable line divider in FIG. 8.

In a particular embodiment, the two reel assemblies (10) are respectively secured on the two walls (30) located at both lateral sides of an entrance, and the line divider belt (20) received in one of the two reel assemblies (10) is configured to be pulled out and attached to the magnetic portion (12) of another reel assembly (10), thus achieving the line divider effect (as shown in FIGS. 8 and 9).

In still a particular embodiment, the two reel assemblies (10) are respectively secured on the walls (30) located at both lateral sides of an entrance, and the two line divider belts (20) are respectively pulled out from of the two reel assemblies (10) and attached with each other through the two magnetic members (21), thus increasing the length of line divider.

Figure 10:
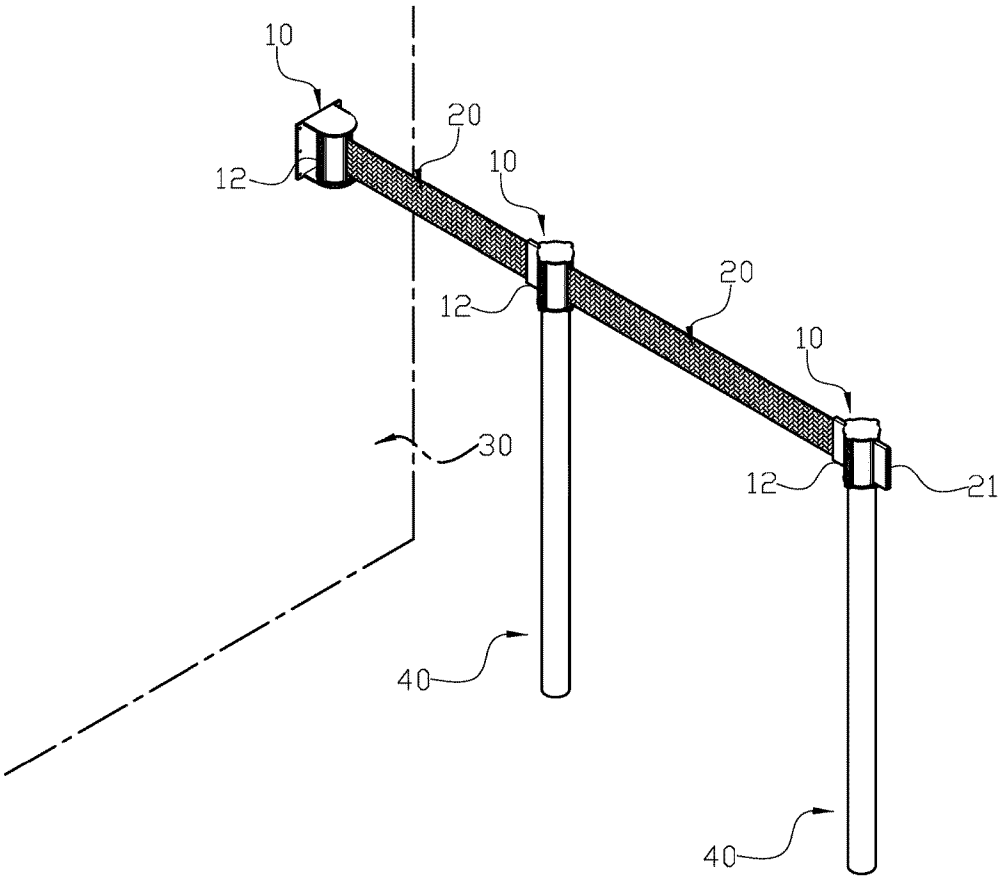
FIG. 10 is the third schematic view of the second embodiment of the magnetic retractable line divider of the present invention when in use.

In a preferred embodiment, at least two reel assemblies (10) are respectively secured on the wall (30) and at least a free-standing vertical post (40), and an entrance is formed between the wall (30) and the vertical post (40) (as shown in FIG. 10).

Figure 11:
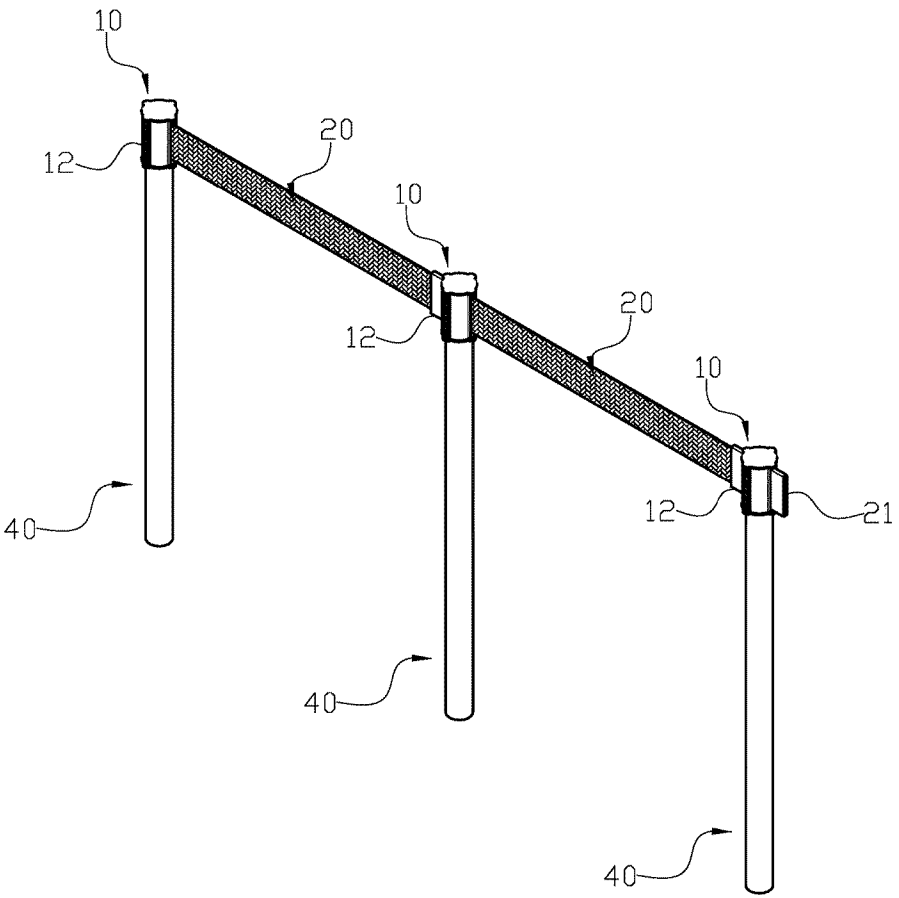
FIG. 11 is the fourth schematic view of the second embodiment of the magnetic retractable line divider of the present invention when in use.

In still a preferred embodiment, at least two reel assemblies (10) are respectively secured on two separated vertical posts (40), and an entrance is formed between the two vertical posts (40) (as shown in FIG. 11).

Figure 12:
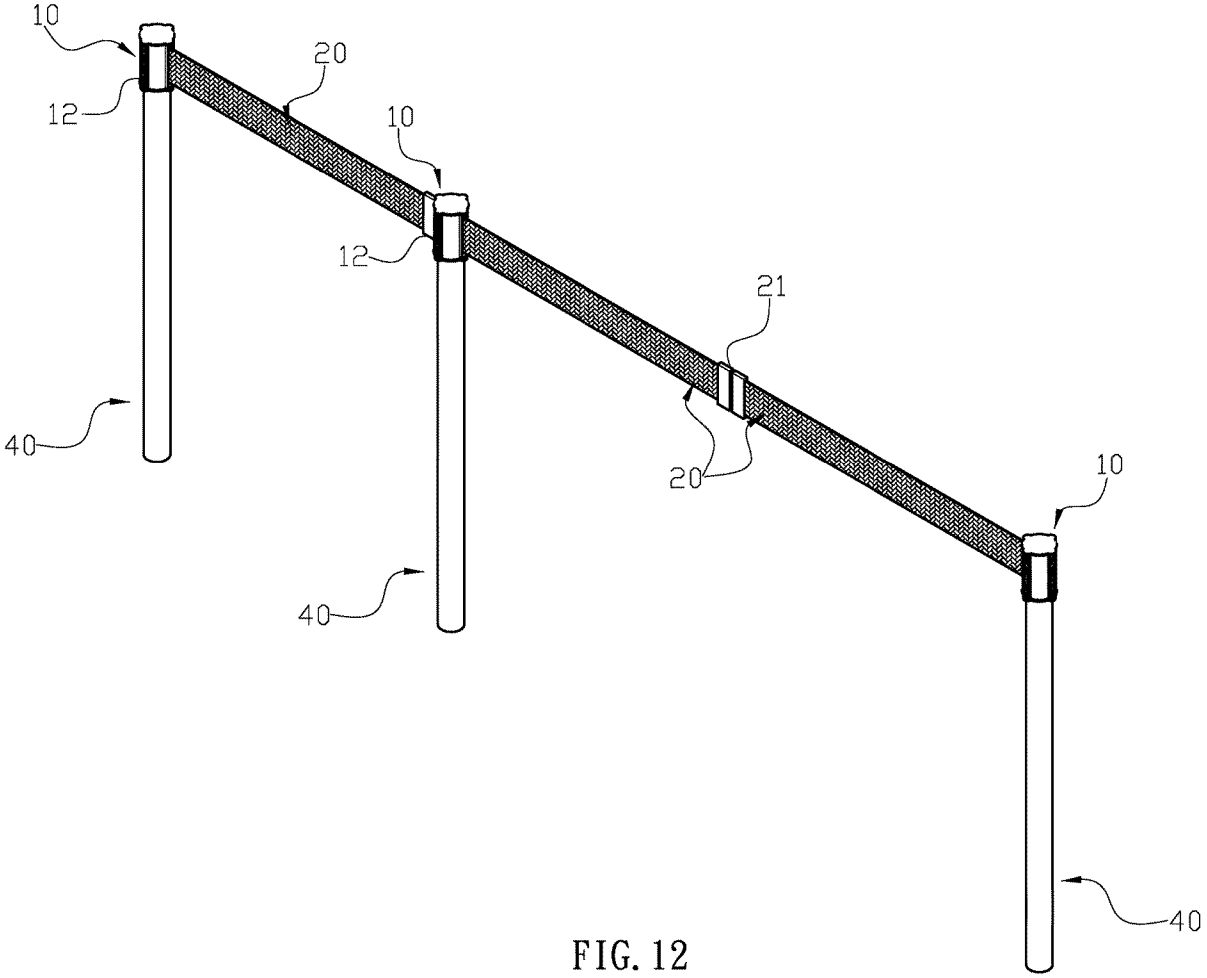
FIG. 12 is the fifth schematic view of the second embodiment of the magnetic retractable line divider of the present invention when in use.

In an advantageous embodiment, at least two reel assemblies (10) are respectively secured on two separated vertical posts (40), and the two line divider belts (20) are respectively pulled out from the two reel assemblies (10) and attached with each other through the two magnetic members (21) such that a wider entrance is formed between the two vertical posts (40) (as shown in FIG. 12).

In still an advantageous embodiment, the vertical post (40) is secured on the floor.

Figure 13:
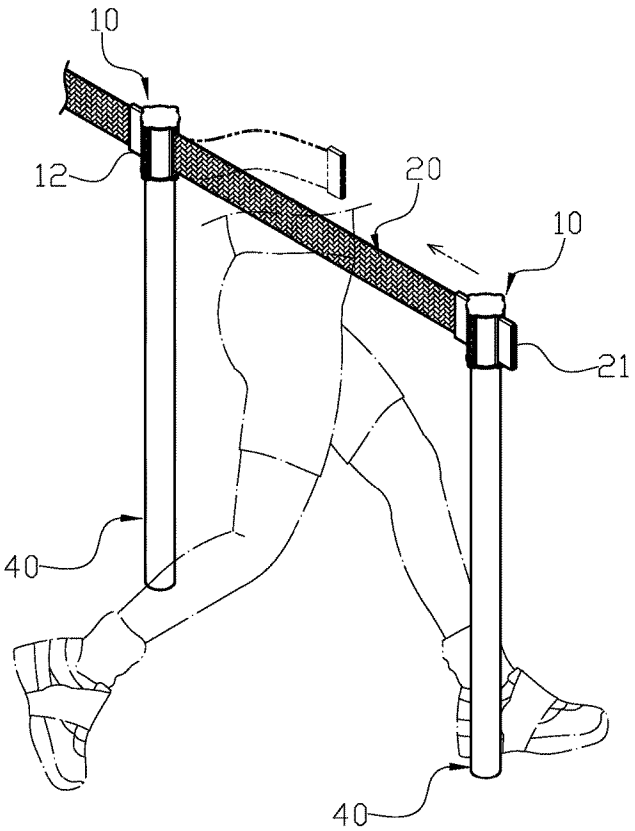
FIG. 13 is a schematic view illustrating a line divider belt is detached from a magnetic portion of a reel assembly when received sufficient pressure thereon.
Figure 14:
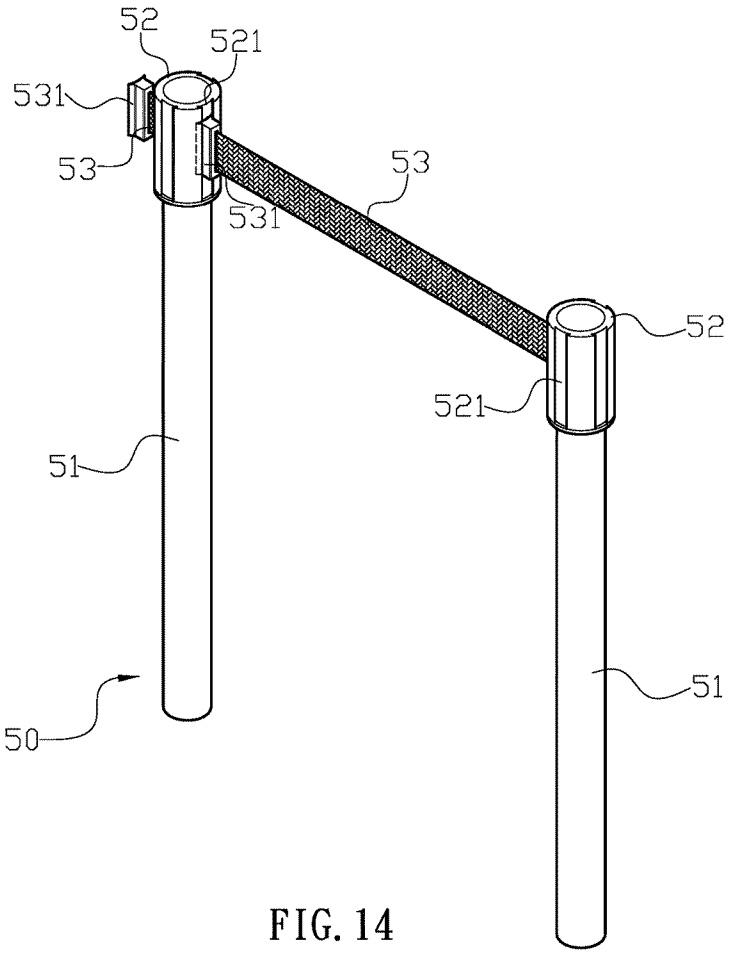
FIG. 14 PRIOR ART
FIG. 14 is a prior art.

Comparing with conventional retractable line divider, the present invention is advantageous because: (i) the line divider belt (20) of one reel assembly (10) is configured to attach to the magnetic portion (12) of another reel assembly (10), the magnetic member (21) of the line divider belt (20) of another reel assembly (10) or the magnetic unit (31) of the walls (30) through magnetic force, instead of the engagement, so that the line divider belt (20) is configured to detach from these said objects when received over a preferred force and retracted into the reel assembly (10) (as shown in FIG. 13). Thus, it can be used more safely in daily life or in emergency.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A magnetic retractable line divider comprising:

at least a reel assembly having a shell, and a magnetic portion installed thereon; an elastic line divider belt wound on the reel assembly, and a magnetic member connected to a lateral end of the line divider belt; wherein the line divider belt is configured to be horizontally pulled out from the reel assembly and travel a preferred distance to attach to a magnetic object, thus blocking an entrance formed between the reel assembly and the magnetic object; when someone pushing against the line divider belt with or over a preferred force, the magnetic member configured to be detached from the magnetic object and retracted into the reel assembly, thus avoiding accidents; an upper locating disk and a lower locating disk respectively located inside the shell of the reel assembly, and a spindle, which is configured to be wound by the line divider belt pivotally connected between the upper locating disk and the lower locating disk; a clock spring positioned in the lower locating disk, and two ends of the clock spring respectively bearing against a bottom portion of the spindle and an inner lower surface of the lower locating disk such that the clock spring, which is compressed or extended between the spindle and the lower locating disk, configured to provide an elastic force to retract or extend the line divider belt; and the shell comprising at least a slot which is configured to be passed through by the line divider belt, and an engaging base secured to the shell, wherein the magnetic portion comprises at least a connecting unit, and the connecting unit further has a locating piece, a line divider section and a magnetic piece; and wherein the locating piece is configured to engage with the engaging base in a top-down manner, and the line divider section is connected to a lateral edge of the locating piece at one end and connected to the magnetic piece at another end, and wherein a rotatable cover installed on the reel assembly has at least one convex portions and at least one concave portions arranged alternatively around an outer periphery thereof; and the cover is configured to turn to allow either of the convex portions to align with the connecting unit, thereby blocking and preventing the locating piece of the connecting unit from disengaging with the engaging base; or the locating piece of the connecting unit is configured to disengage with the engaging base when aligned with either of the concave portions of the cover; and a locating unit disposed between the cover and the upper locating disk is configured to position the cover after each turn.

2. The magnetic retractable line divider of claim 1, wherein the magnetic member is a magnet.

3. The magnetic retractable line divider of claim 1, wherein the reel assembly is configured to be secured on a wall located at one lateral side of an entrance or access, and a magnetic unit is configured to be embedded in another wall located at another lateral side of the entrance; and wherein the magnetic unit is a metal piece or a magnet.

4. The magnetic retractable line divider of claim 1, wherein two of said reel assemblies are configured to be respectively secured on two walls respectively located at two lateral sides of an entrance.

5. The magnetic retractable line divider of claim 4, wherein at least two of said reel assemblies are configured to be respectively secured on a wall and at least a free-standing vertical post, and an entrance is formed between the wall and the vertical post.

6. The magnetic retractable line divider of claim 4, wherein at least two of said reel assemblies are configured to be respectively secured on two separated vertical posts, and an entrance is formed between the two vertical posts.

* * * * *